United States Patent [19]

Hildebrandt

[11] Patent Number: 4,948,136

[45] Date of Patent: Aug. 14, 1990

[54] SPINNING TOP GAME

[76] Inventor: Edmund Hildebrandt, 6 Cedar St., Clinton, Mass. 01510

[21] Appl. No.: 354,840

[22] Filed: May 22, 1989

[51] Int. Cl.[5] ..... A63B 67/14; A63H 1/28

[52] U.S. Cl. ..... 273/109; 446/258

[58] Field of Search ..... 273/109; 446/256, 261, 446/258

[56] References Cited

U.S. PATENT DOCUMENTS

| | | | |
|---|---|---|---|
| 197,393 | 11/1877 | Murphy | 446/256 |
| 576,982 | 2/1897 | Lang | 446/258 |
| 708,766 | 9/1902 | Hazlehurst | 446/258 |
| 773,072 | 10/1904 | Griffin | 446/258 |
| 3,191,341 | 6/1965 | Martin | 273/109 |
| 3,863,925 | 2/1975 | Torgow | 446/261 |
| 4,681,320 | 7/1987 | Hildebrandt | 273/109 |

FOREIGN PATENT DOCUMENTS

| | | | |
|---|---|---|---|
| 10406 | 7/1909 | France | 446/256 |
| 2614800 | 11/1988 | France | 446/256 |

*Primary Examiner*—Randall L. Green
*Assistant Examiner*—Gary Jackson
*Attorney, Agent, or Firm*—Charles R. Fay

[57] ABSTRACT

A spinning top game wherein a rounded head or "point" on a top allows the top to spin continuously on a supporting board as long as the operator correctly alters the tilt of the board so that the top is always proceeding downwardly.

3 Claims, 2 Drawing Sheets

SPINNING TOP GAME

BACKGROUND OF THE INVENTION

This invention was discovered in the use of the game described in U.S. Pat. No. 4,681,320, July 21, 1987. It was found that if the board were to be manipulated so that the top would be supported on and continually spinning down an inclined surface, the top would continue to spin as long as a person could manipulate the board. Without any motive power except the usual string or cord wrapped about the top and pulled in a well-known manner, the top has been kept going for as long as three-quarters of an hour.

SUMMARY OF THE DISCLOSURE

The body of the top is of wood, plastic, or any suitable material, and has a wider portion on which to wind the spinning cord and a tapering portion having a "point" on which to spin. This "point" is not pointed; it is hemispherical, or at least well rounded, as shown in the patent. The board on which the top spins on its rounded "point" may be stiff or even flexible with side edge stiffening members to hold the flexible "board" extended so that it can act as a support for the top and still be rolled up for carrying and to place in the pocket. Whether rigid or flexible, the top support is preferred to bear a design, as part of the game is to see how close to the design the participant can hold the top while it is spinning.

PREFERRED EMBODIMENT OF THE INVENTION

Figure 1:
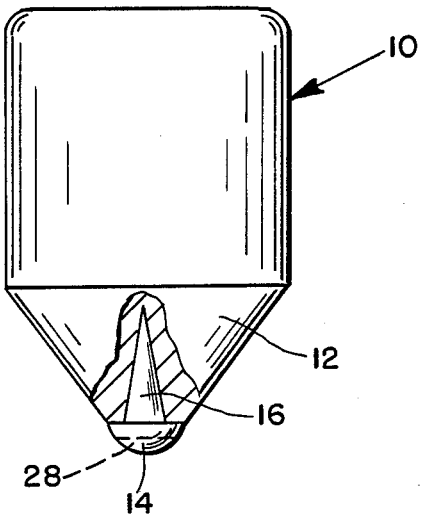
FIG. 1 is an elevational view partly in section of the top of the invention.
Figure 2:
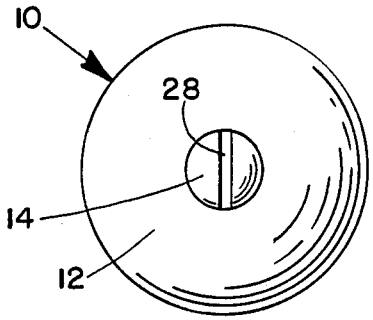
FIG. 2 is a bottom plan view thereof.

FIGS. 1 and 2 show a top that can be used in the present invention. This top has a wider or larger portion 10, that is shown herein as cylindrical, that serves to receive a cord or string wound around it and imparting a spinning action to the top in a well-known manner. Another portion 12 tapers down to the spinning head or "point" 14. This so-called "point" or end will not work in this invention which is definetly limited to a rounded, preferable hemispherical "point" or head as shown. This rounded end may be the head of a pin-like or nail-like spindle 16 hammered or otherwise placed in the body of the top. The tapered part 12 is conical, with head or "point" 14 at the extreme small end. Other forms of the top as well as material amy be used without departing from the invention, but the head or "point" 14 has to be rounded.

Figure 3:
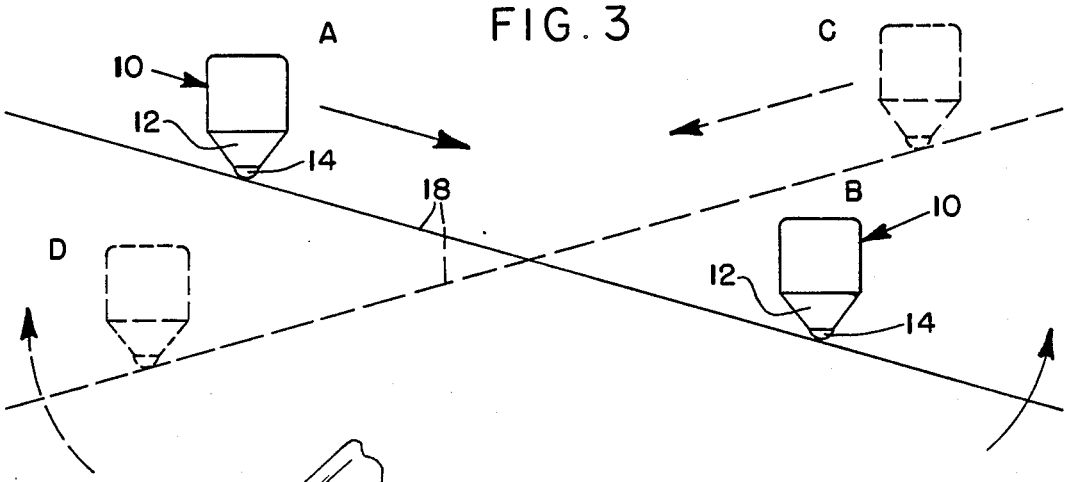
FIG. 3 is a diagram showing the top of FIGS. 1 and 2 being spun on a rigid board.
Figure 5:
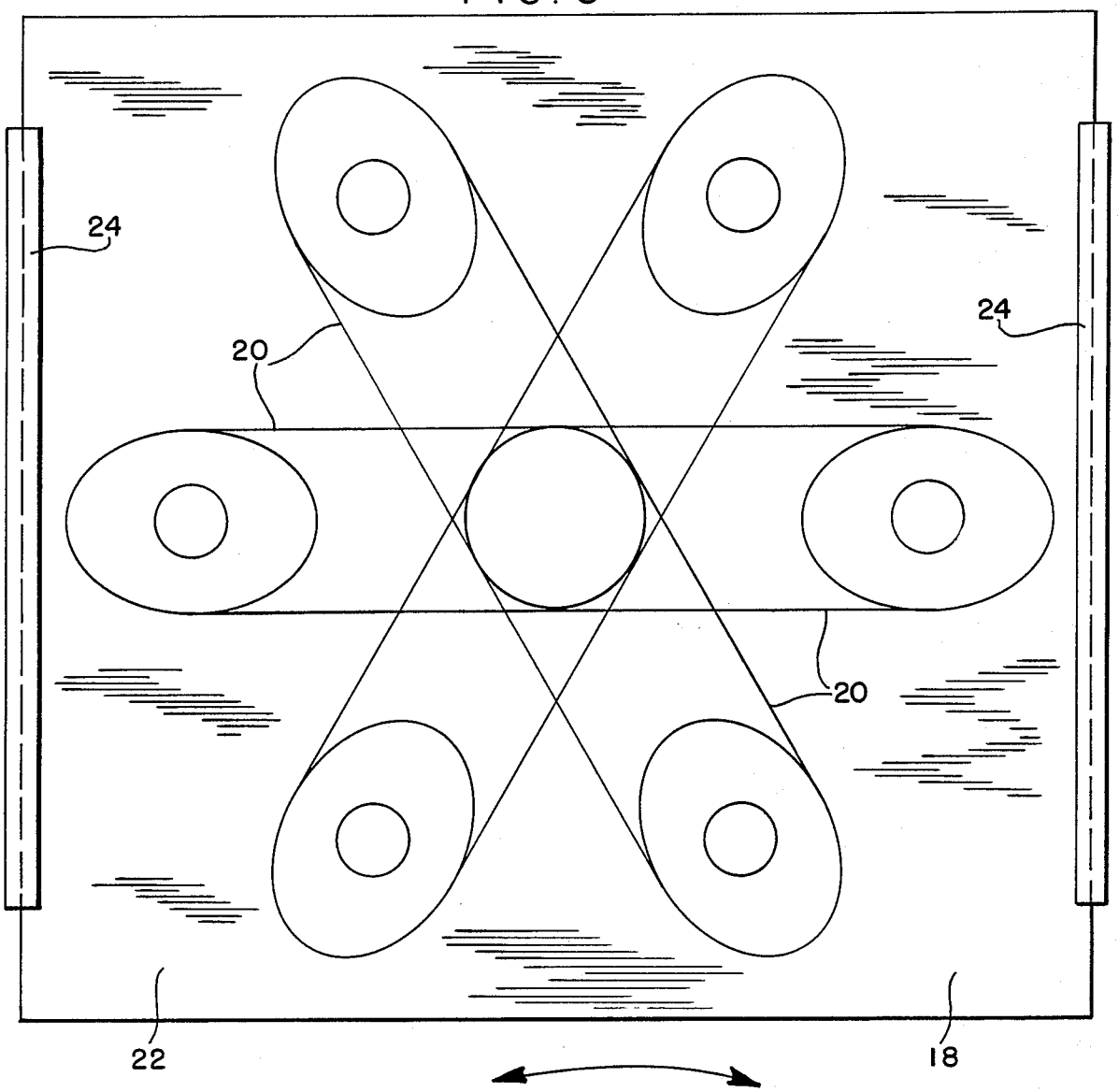
FIG. 5 is a plan view of a board or other top support with tracks imprinted thereon.

FIG. 3 shows a rigid board 18 of cardboard or other suitable material, and this board preferably is provided with a designated track or path 20, see FIG. 5, to which the path of progress of the top must be kept in some forms of the game, but the point here is that once the top is spun as usual, the board 18 is grasped at the two opposite side edges thereof and tilted so that the top being at A or thereabouts travels by gravity down the slope to B, FIG. 3. When B is reached, the board is tilted back and the top moves back down the new slope, from point C to point D, etc. The top tends to remain spinning on a vertical axis, but is tilted out of such a position on occasion; depending on the speed of the tilting action and whether a somewhat rotary motion is imparted to the board as the top moves down, as in making the top follow a track.

Figure 6:
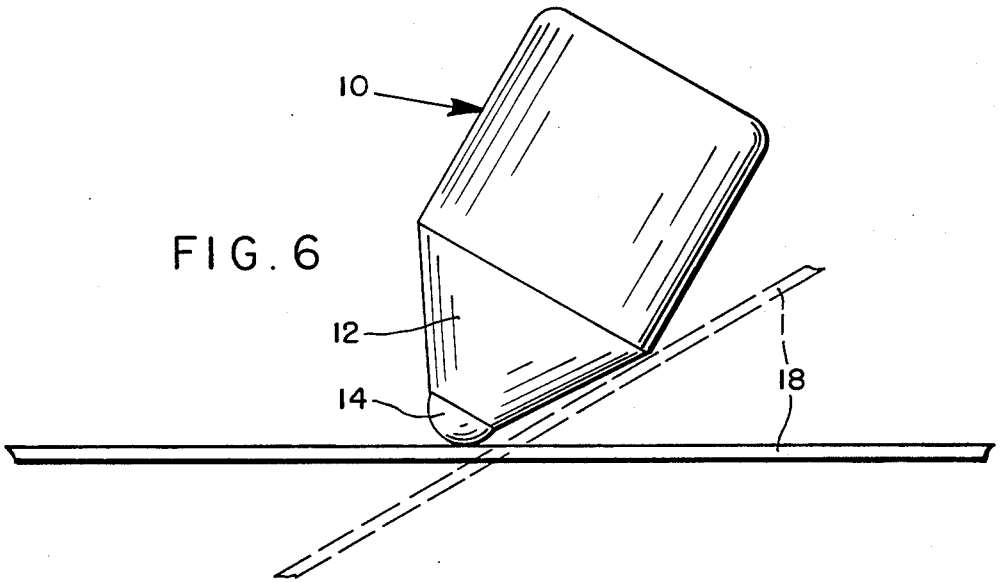
FIG. 6 is a diagrammatic view of the top while spinning on an axis inclined to the plan of its support.

FIG. 6 is an attempt to illustrate the action of the top as it descends, or the board is tilted merely in an effort to keep the top in its track. In FIGS. 3 and 6 the top is spinning but with different points on the head or "point" 14 actually engaged with the surface of the top supporting board. Thus, the shape of the head or "point" 14 is important and rounded or hemispherical is the best shape for the continual spinning action. A good operator can keep the top spinning until his arms become too tired to continue rocking, i.e. tilting the board in different directions, so that the top is always traveling downwardly from any position on the board.

Figure 4:
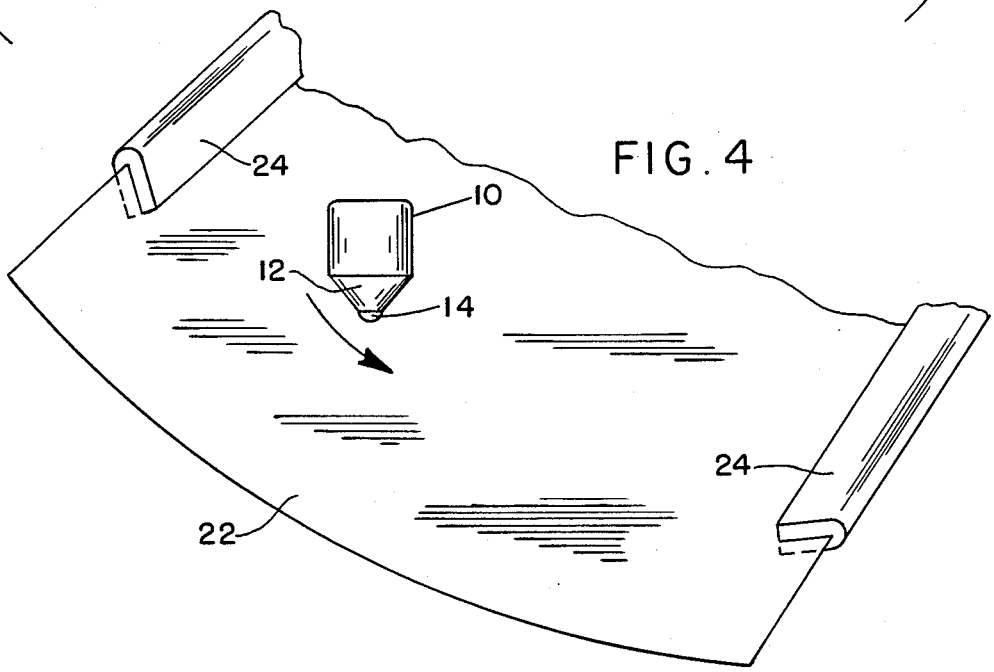
FIG. 4 is a perspective view showing the top on a flexible support that can be rolled up.

While this game is mostly a child's game, it can be of interest to adults, as in contests to see who can keep the top spinning for the longest period of time. Small mistakes can abrogate the spinning action, or slow it down, so that an element of skill enters. If it is desired to fold the top supporting member, it may be made of flexible material as at 22 in FIG. 4, where the top supporting member may be fabric, film, thin plastic, etc. In this case it is preferred to apply edge stiffeners 24 which are in the form of springy, detachable, rigid U-shaped plastic clips that serve as handles. These clips are parallel and allow the flexible sheet 22 to be rolled up and put in a pocket or purse.

Looking at FIGS. 3 and 6, it will become clear that a point instead of a round head on the top will tend to dig in and slow or stop the action.

It has been found that a whirring noise can be produced as the top spins, simply by producing a cross slot as at 28 wherein the slot has edges that engage the surface of the member on which the top spins. This slot is like a slot in the head of a screw for the acceptance of the driving edge of a screw driver, whether standard cross slot, or the Phillips type, or of any other shaped slot that is in contact with the surface on which the top spins.

It has been shown in practice that properly handled, the top will spin as long as the board 18 or 22 is tilted correctly and especially at the right intervals. Thus, a machine made to tilt and reverse in timely fashion will cause the top to spin indefinetly, and a person can keep it going until his arms give out through fatigue.

Also, the slot 28 may be much smaller and of any shape. Even a scratch over the center of the ball-tip 14 will cause a sound. The tip can be changed as much as desired, to produce various sounds.

I claim:

1. The method for keeping a spinning top in continuous spinning action that comprises providing a co-planar surface member upon which to spin the top, wherein said surface is manually manipulatable, and a top having a rounded element on which it spins, spinning the top with the rounded element engaging the surface of the member, and manipulating the member so that the spinning top continually moves downwardly, including the step of producing a whirring sound by the spinning top, the sound being caused by the provision of a slot in the rounded member, the edges of the slot engaging the surface of the member as the top spins.

2. The combination of a spinning top and means to impart a spinning action to the top, with a member having a surface upon which to spin the top, said member being manually manipulatable by a person gripping opposite edges of the member, so that, once the top has started to spin on the surface, the latter may be given a constantly downward slant a rounded spinning point on the top for direct engagement with the surface, whereby the top may spin on an axis inclined relative to the plane of the surface, including a cross slot on the rounded point of the top, the slot having edges that engage the surface as the top spins.

3. A game comprising a manually manipulatable member, a surface on the member on which a top may be spun, said surface being generally co-planar and the member being of a nature so the entire surface can be positioned on an incline, a top, means to spin the top, the top having a portion to accept the means to spin it and tapering portion terminating in a blunt point, and a rounded tip on the point for top-spinning engagement with the surface of the member, and including a cross slot in the rounded tip, the slot having edges that engage the surface on the member as the top spins, producing a generally continuous whirring sound.

* * * * *